United States Patent [19]

Gage

[11] 4,184,680

[45] Jan. 22, 1980

[54] ARTILLERY GAME AND PLAYING METHOD

[76] Inventor: Walter T. Gage, 1600 Stubbeman St., Norman, Okla. 73069

[21] Appl. No.: 917,514

[22] Filed: Jun. 21, 1978

[51] Int. Cl.[2] ..... A63B 65/12

[52] U.S. Cl. ..... 273/101; 124/26; 124/32; 273/102 R

[58] Field of Search ..... 273/101, 255, 262, 265, 273/32 H, 87.2, 87.4, 32 H, 176 L, 95 R, 95 B; 124/16, 32, 29, 26, 95 H

[56] References Cited

U.S. PATENT DOCUMENTS

| | | | |
|---|---|---|---|
| 714,770 | 12/1902 | Zelch | 124/29 |
| 1,102,948 | 7/1914 | Norton | 124/29 |
| 1,402,637 | 1/1922 | Miller | 273/101 |
| 2,290,669 | 7/1942 | Bowie | 273/255 |
| 2,295,225 | 9/1942 | Lohr et al. | 273/101 |
| 2,996,835 | 8/1961 | Giuliano | 273/95 R X |
| 3,009,700 | 11/1961 | Dolega | 273/95 H |
| 3,202,425 | 8/1965 | Van Hennik | 273/95 B X |
| 3,467,383 | 9/1969 | Miermans | 273/101 |
| 3,820,786 | 6/1974 | Candor | 273/176 L X |
| 4,093,236 | 6/1978 | Hoffa | 273/262 X |

FOREIGN PATENT DOCUMENTS

| | | | |
|---|---|---|---|
| 362121 | 9/1915 | Fed. Rep. of Germany | 273/101 |
| 22890 | of 1914 | United Kingdom | 273/101 |

*Primary Examiner*—George J. Marlo

*Attorney, Agent, or Firm*—Laney, Dougherty, Hessin & Beavers

[57] ABSTRACT

Apparatus and methods are provided for a game including a playing board having means for pivotally mounting a plurality of projectile shooting cannons. The playing board includes first and second orthogonal grid indicia arrays so that the location of a movable target may be designated by indicating specific first and second grid indicia, of the first and second orthogonal arrays, respectively. Also included is a plotting chart which comprises a scale reproduction of the playing board, including grid indicia arrays which are scaled duplicates of the grid indicia arrays of the playing board. A direction and range finder is provided for use with the plotting chart so that the direction and range of the movable target on the playing board may be determined by marking the location of the target on the plotting chart with a plotting pin and then rotating the direction range finder until it engages the plotting pin. The direction and range finder includes a protractor type direction finder portion and a straight edge type range finder portion. The cannons may be pivoted about both horizontal and vertical axes so as to vary the direction angle of elevation at which the projectile is ejected from the cannon. The appropriate elevation angle is determined by means of an elevation finder chart which indicates the proper elevation for a given range.

15 Claims, 6 Drawing Figures

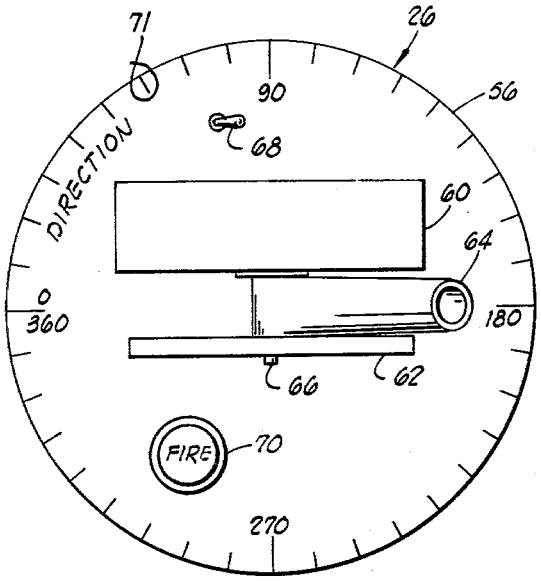
FIG. 3
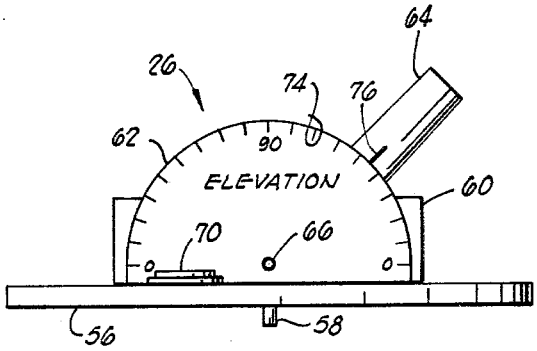
FIG. 4
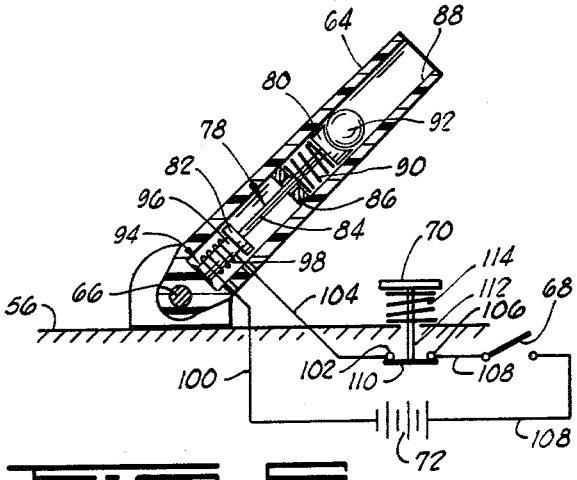
FIG. 5
116
120
118
| ELEVATION FINDER | |
|---|---|
| RANGE | ELEVATION |
| | 30° |
| | 35° |
| | 40° |
| | 45° |
| | 50° |
| | 55° |
| | 60° |
| | 65° |
| | 70° |
| | 75° |
| | 80° |
| | 85° |
| | 90° |
FIG. 6

ARTILLERY GAME AND PLAYING METHOD

BACKGROUND OF THE INVENTION

1. Field of the Invention

This invention relates generally to apparatus for playing games, and more particularly, but not by way of limitation, to apparatus and methods for an artillery game including cannons pivotal about both vertical and horizontal axes on a playing board, a scaled plotting chart reproduction of the playing board, and a direction and range finder for use in conjunction with said plotting chart and an elevation finder.

2. Description of the Prior Art (Prior Art Statement)

The following statement is intended to be a prior art statement in compliance with the guidance and requirements of 37 CFR §§1.56, 1.97 and 1.98 and with §609 of the Manual of Patent Examining Procedure.

The prior art includes apparatus for playing games including cannons for directing a projectile towards a designated target. Such prior art apparatus are represented by U.S. Pat. No. 3,467,383 to Miermans; U.S. Pat. No. 3,202,425 to Van Hennik; U.S. Pat. No. 2,295,225 to Lohr et al; U.S. Pat. No. 1,402,637 to Miller; U.S. Pat. No. 1,102,948 to Norton; and U.S. Pat. No. 714,770 to Zelch.

Also of possible interest are U.S. Pat. No. 3,009,700 to Dolega and U.S. Pat. No. 2,996,835 to Giuliano which show other types of projectile apparatus used in various games.

Although certain aspects of the present invention, such as cannons similar to those mentioned above, are shown in the prior art, none of the prior art references disclose an artillery game including a playing board having two orthogonal arrays of grid indicia, a plotting chart including a scale version of said grid indicia, and a direction and range finder which may be used, in conjunction with said plotting chart and an elevation finder, to calculate the appropriate vertical and horizontal orientation of the cannon, so that a projectile may be directed to hit a target located at a given point designated by specific first and second grid indicia.

SUMMARY OF THE INVENTION

Apparatus and methods are provided for a game including a playing board having means for pivotally mounting a plurality of projectile shooting cannons. The playing board includes first and second orthogonal grid indicia arrays so that the location of a movable target may be designated by indicating specific first and second grid indicia, of the first and second orthogonal arrays, respectively. Also included is a plotting chart which comprises a scale reproduction of the playing board, including grid indicia arrays which are scaled duplicates of the grid indicia arrays of the playing board. A direction and range finder is provided for use with the plotting chart so that the direction and range of the movable target on the playing board may be determined by marking the location of the target on the plotting chart with a plotting pin and then rotating the direction range finder until it engages the plotting pin. The direction and range finder includes a protractor type direction finder portion and a straight edge type range finder portion. The cannons may be pivoted about both horizontal and vertical axes so as to vary the direction angle of elevation at which the projectile is ejected from the cannon. The appropriate elevation angle is determined by means of an elevation finder chart which indicates the proper elevation for a given range.

It is therefore a general object of the present invention to provide an improved artillery game.

A further object of the present invention is to provide an improved game, using cannons for shooting projectiles, so that the proper vertical and horizontal orientation of the cannon can be determined in order to hit a given target location.

Another object of the present invention is to provide an artillery game having a plotting chart including a scale reproduction of a playing board having two orthogonal arrays of grid indicia.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 3 is a plan view of the cannon of the present invention.

FIG. 4 is an elevation view of the cannon of FIG. 3.

FIG. 5 is a partially sectional schematic view of the cannon of FIG. 3 including a schematic representation of its electrical system.

FIG. 6 shows a typical elevation finder chart for use in calibrating the cannon of FIG. 3 and subsequently determining the proper elevation of the cannon to shoot a projectile toward a specific target location.

DETAILED DESCRIPTION OF THE PREFERRED EMBODIMENTS OF THE INVENTION

Figure 1:
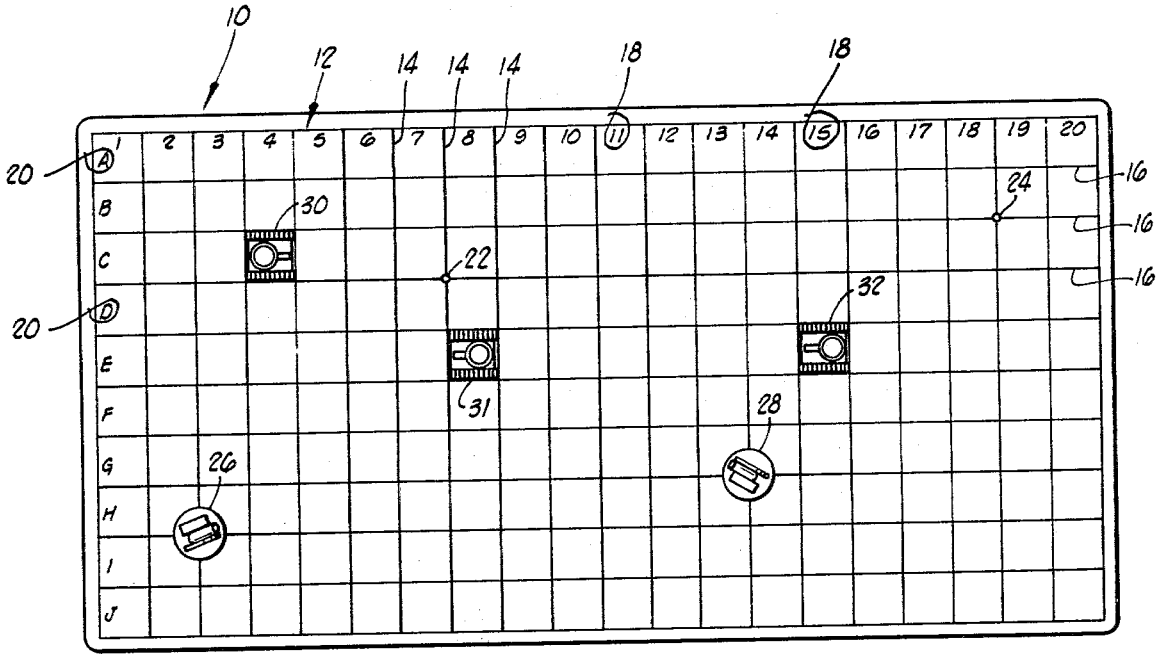
FIG. 1 is a plan view of the playing board of the present invention.

Referring now to the drawings and particularly to FIG. 1, the playing board of the present invention is shown and generally designated by the numeral 10.

The playing board 10 includes a rectangular range 12 which is divided into a plurality of square grid areas by a first array of spaced parallel grid indicia 14 and a second array of spaced parallel grid indicia 16, said first array of grid indicia 14 being orthogonal or perpendicular to said second array of grid indicia 16. Preferably the grid indicia overlay an artwork background depicting bridges, trees, hills and the like. In its preferred embodiment the playing board 10 is relatively large, having dimensions on the order of 100 inches by 50 inches.

Each of the square grid areas between adjacent grid indicia 14, of said first array, is identified by numerical grid area designation means 18. Each of the square grid areas between adjacent grid indicia, of said second array, 16 is identified by alphabetical designation means 20.

The playing board 10 includes four cylindrical cannon receiving holes. The two upper cannon receiving holes as viewed in FIG. 1 are designated by the numerals 22 and 24. The two lower cannon receiving holes (not shown) are located below cannons 26 and 28. These cannon receiving holes are preferably constructed by inserting pop rivets into the playing board 10. The playing board 10 is constructed so as to fold into a smaller shape for more convenient storage.

Also located upon the playing board 10 are movable targets 30, 31 and 32. The movable targets preferably are in the form of model tanks and are of such a size to completely fill one of the substantially square grid areas defined by the intersection of a pair of parallel adjacent first grid indicia 14 with a pair of parallel adjacent second grid indicia 16. As will be further explained below, the precision with which the location of the movable targets may be specified on the plotting chart is greatly enhanced if the movable targets are of such a size as to totally fill one of the above-described square grid areas.

Figure 2:
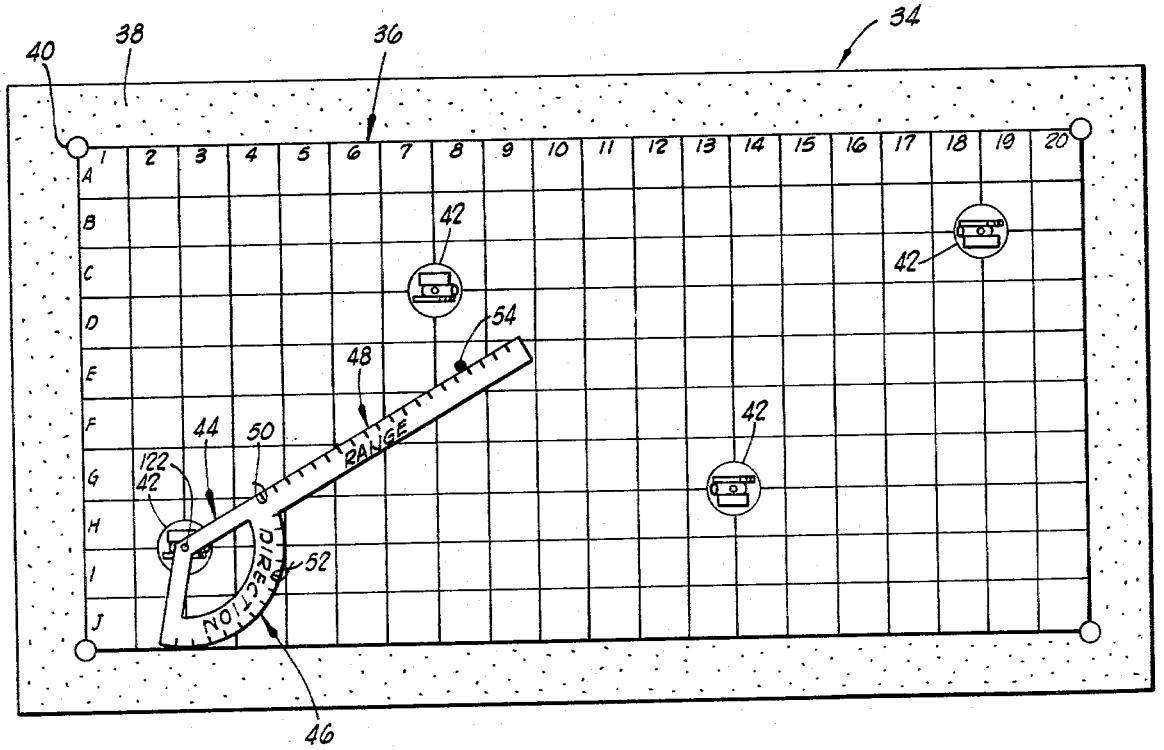
FIG. 2 is a plan view of the plotting chart of the present invention.

Referring now to FIG. 2, a targeting system of the present invention is shown and generally designated by the numeral 34. The targeting system 34 includes a plotting chart 36 which is held to a plotting board 38 by a plurality of thumbtacks 40. The plotting chart 36 is preferably constructed of a heavy waterproof paper or plastic so that it may withstand considerable abuse and perforation while still remaining useable. The plotting board 38 is preferably made of a cork-like material so as to readily receive the thumbtacks 40.

The plotting chart 36 includes a reduced scale reproduction of the rectangular range 12 of the playing board 10. The plotting chart 36 has reproduced thereon the first and second arrays of orthogonal grid indicia 14 and 16 along with the respective numerical and alphabetical identifying designation means 18 and 20 of the square grid areas defined by those grid indicia. Also reproduced upon the plotting chart 36, at locations corresponding to the locations of the four cannon receiving holes of the playing board 10, are graphic reproductions 42 of cannons such as the cannons 26 and 28.

Pivotally mounted upon the plotting chart 36 and the plotting board 38, at a point corresponding to the location of one of the cannon mounting holes of the playing board 10, is a combination direction-range finder or determining means 44. The direction-range determining means 44 includes a protractor-like direction determining means 46 with a straight edge type range determining means 48, rigidly extending therefrom.

The range finder means has range indicia 50 thereon which are scaled to permit convenient correspondence between the major divisions of the range indicia 50 and the dimensions of one of the square grid areas of the plotting chart 36. For example, if the square grid areas of the plotting chart have dimensions of one inch square, then a one inch length of the range determining means would have identifying designations thereon specifying that one inch on the plotting chart equals 100 meters of range.

The protractor type direction finder means 46 includes direction indicia 52 which may be used to determine the angle from a given reference line, such a reference line being, for example, one of the grid indicia lines 14 and 16 which intersect at the point of pivotal connection of the direction-range finder to the plotting chart. The angle thus determined is the angle at which the cannon 26 should be oriented to hit a given target. Preferably the direction indicia 52 are arranged so that a "zero" direction marking will be aligned with one of the first grid indicia 14 when the straight edge range finder means is oriented parallel to one of the grid indicia 16 of the second grid array.

A target location upon the playing board 10 is represented upon the plotting chart 36 by a map tack 54 which is placed upon the plotting chart at a location upon the plotting chart grid corresponding to the location of the target upon the similar playing board grid.

As indicated above, it is often preferable for the targets 30, 31 and 32 to be of such dimensions as to fully cover one of the square grid areas defined by intersecting pairs of adjacent grid indicia 14 and 16. This allows the location of the target to be completely designated by specifying one particular numerical designation means 18 and one particular alphabetical designation means 20. To represent the location of the target on the plotting chart 36, the plotting pin 54 may then be located in the center of a square grid area, said center being defined by the intersection of the diagonals of the square. Also, with these relatively large targets, extreme accuracy is not so essential, and the game is more suitable for younger players.

In systems having targets sized smaller than the square grid areas, the representative location of a target upon the plotting chart 36 generally is less precise than that described above. This precision can, of course, be improved by subdividing the square grid areas by means of additional arrays (not shown) of orthogonal sub-grid indicia.

Referring now to FIGS. 3 and 4, the external construction of the cannon 26 is shown. The cannon 28 is of similar construction. The cannon 26 includes a circular base plate 56 which is mounted in one of the cannon receiving holes, such as the holes 22 and 24, of the playing board 10, by means of a cylindrical mounting extension 58 centrally protruding from the center of the lower surface of the base plate 56. Extending vertically upward from the base plate 56 are first and second cannon barrel mounting shoulders 60 and 62. Pivotally mounted between the cannon barrel mounting shoulders 60 and 62 is a cannon barrel 64 which pivots about cannon axle 66.

Mounted upon the upper surface of the base plate 56 is an on-off toggle switch 68 and a firing button 70. Located about the periphery of the upper surface of the base plate 56 are a plurality of cannon direction indicia 71.

The first cannon barrel mounting shoulder 60 is preferably of such a shape and construction that it may receive a conventional dry cell battery 72, or other electrical power source, therein.

The second cannon barrel mounting shoulder 62 is of a protractor-like configuration as is best seen in FIG. 4, and also serves as an elevation indicating means. The elevation indicating means 62 has disposed thereon a plurality of elevation indicia 74. An elevation reference indicator 76 is located upon the barrel 64 and may be used in conjunction with the elevation indicia 74 to specify the position of the cannon barrel 64 about its horizontal axis of rotation.

Referring now to FIG. 5, the internal construction of the cannon barrel 64 is shown in a schematic manner along with a schematic representation of the electrical system of the cannon 26. The cannon barrel 64 has disposed therein a plunger 78 having a concave projectile receiving upper end 80 and a flat lower magnet engaging end 82. The upper and lower ends 80 and 82 are rigidly connected by a cylindrical plunger rod 84.

The cylindrical plunger rod 84 is disposed within a central cylindrical bore of spring retaining shoulder 86. The spring retaining shoulder 86 is of a doughnut shape and is fixedly attached to an internal cannon bore 88 of the cannon barrel 64.

Located between the upper surface of the spring retaining shoulder 86 and the projectile receiving end 80 of the plunger 78 is a resilient helical compression spring 90.

Freely resting within the concave surface of the projectile receiving end 80 is a spherical projectile or cannon ball 92.

Attached to the lower end of the internal cannon bore 88 is an electromagnet 94 having a magnet core 96 and an electrical winding 98. One end of the electromagnet winding 98 is connected to the battery 72 by first electrical connecting means 100. The other end of the electromagnet winding 98 is connected to a first firing button contact 102 by second electrical connecting means 104.

The battery 72 is also connected to a second firing button contact 106 by a third electrical connecting means 108 which has disposed therein the on-off switch 68.

The first and second firing button contacts 102 and 106 are connected by firing button contact plate 110 which is attached to the bottom of a firing button plunger 112. When the firing button 70 is not depressed, the firing button contact plate 110 is held in contact with the firing button contacts 102 and 106 by means of the spring 114. The firing button 70 is said to be normally closed.

The operation of the firng mechanism of the cannon 26 is as follows. As shown in FIG. 5, a cannonball 92 has been placed within the cannon barrel 64 and the plunger 78 has been pushed into the cannon barrel 64 until the magnet engaging end 82 engages the electromagnet 94. With the firing button 70 in the undepressed position, and with the switch 68 in a closed position, the electromagnet 94 is energized and will hold the plunger 78 in the position shown in FIG. 5. To fire the cannon, the firing button 70 is depressed, thereby moving the firing button contact plate 110 out of engagement with the firing button contacts 102 and 106, thereby breaking the electrical circuit to the electromagnet 94 and de-energizing the same. When the electromagnet 94 is de-energized, the lower magnet engaging end 82 of the plunger 78 is released and the plunger 78 is rapidly moved, from a first cocked position as shown in FIG. 5, towards the upper open end of the cannon barrel by the extension of the helical compression spring 90. This system may also be replaced by an equivalent mechanical release mechanism, as will be understood by those skilled in the art.

When the helical compression spring 90 is fully extended, the cannonball 92 will be ejected from the cannon barrel 64. The plunger 78 is then in a second uncocked position (not shown). Since the diameter of the lower magnet engaging end 82 of the plunger 78 is greater than the diameter of the internal bore of the spring retaining shoulder 86, the plunger 78 will be retained within the cannon barrel 64. The construction of the cannon 26 is such that the projectile receiving end 80 does not extend past the end of the cannon barrel 64 when the spring 90 is fully extended.

Referring now to FIG. 6, an elevation finder means is shown and generally designated by the numeral 116. The elevation finder 116 has disposed thereon a range tabulating column or means 118 and an elevation tabulation column or means 120.

OPERATION OF THE ARTILLERY GAME

A first step which should be conducted prior to actually using the cannon 26 to fire at a tank target is to calibrate the elevation finding means 116. This is done by setting the elevation of the cannon at some convenient angle and firing the cannonball a sufficient number of times, for example five or six times, and taking the average of the distance traveled by the five or six firings, which average is then entered in the range column. There will, of course, be some slight deviation in the distance traveled by the cannonball for a given angle between various firings. To reduce this deviation to a minimum, it is desirable that the internal bore 88 of the cannon barrel 64 be lubricated by the use of dry talcum powder or some similar means to prevent the sticking of the moving components within the cannon barrel 64.

It is preferable that the elevation finder be recalibrated at periodic intervals due to the changes which will occur in the spring constant of the helical compression spring 90 with age and use.

Although it is possible to calibrate the cannon 26 for firing projectiles at angles of less than 45° from the horizontal, so as to achieve a low relatively flat trajectory, it is preferable, in the artillery game of the present invention, to construct the cannon 26 and the playing board 10, so that all target locations on the playing board 10 may be hit by a projectile 92 fired at a relatively high trajectory greater than 45° from the horizontal. This has the additional safety feature of decreasing the likelihood that a player might be injured by a flying projectile striking him in the eye or face.

The typical manner in which the apparatus of the present invention is then used to locate a target and direct a projectile towards the same is as follows.

First, the location of a given target upon the playing board 10 is determined. For example, if it is desired to fire a projectile at the tank target 31, it is determined that the target 31 lies within the square grid area identified by the alphabetical and numerical designations E-8. The map tack 54 is then placed in the center of the square grid area of the plotting chart 36 which also corresponds to the designation E-8. The combination direction-range finder 44 is then rotated about pivot pin 122 until the straight edge range finder portion 48 engages the map tack 54. The range of the target is then determined from the range indicia 50 of the range determining means 48. The proper elevation for the gun 26 is then determined by use of the elevation finding means 116. The range of the target is located in the range tabulation column 118 and the proper corresponding elevation is then determined from the elevation column 120. In some instances interpolation may be necessary between those values listed upon the chart. The cannon barrel 64 is then set at the proper elevation by rotating the cannon barrel until the elevation reference indicator 76 corresponds to the elevation indicia 74 which is equivalent to the elevation determined from the elevation finding means 116.

The proper orientation of the cannon 26 about its vertical axis is then determined by use of the direction determining means 46. The angle between a straight line to the target and one of the grid indicia lines 14 and 16 intersecting at the point of rotation of the range direction finding means 44 is determined by use of the direction indicia 52. The cannon 26 is then oriented upon the playing board 10 at an equivalent angle about a vertical axis, by means of the corresponding cannon direction indicia 71.

The cannon 26 is then properly oriented so as to direct the cannonball 92 towards the target tank 31. The on-off switch 68 is then placed in the on position. A cannonball 92 is placed in engagement with the projectile receiving end 80 of the plunger 78, and the plunger 78, along with the cannonball 92, is pushed downward into the cannon barrel 64 until the magnet engaging end 82 contacts the electromagnet 94. Then, to fire the cannonball 92 at the tank target 31, the firing button 70 is depressed, thereby ejecting the cannonball 92 from the cannon barrel 64 in the manner previously described.

An additional feature, which is often used in conjunction with the apparatus described above, is a deck of instructional cards and/or a pair of dice, to direct players when and where to move their targets and when to fire the cannons.

Thus, the apparatus and methods for artillery games of the present invention are well adapted to carry out the objects and attain the ends and advantages mentioned, as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. An artillery game, comprising:

a playing board, having disposed thereon grid indicia so that the location of a target upon said playing board may be identified by reference to said grid indicia;

a plotting chart, having disposed thereon a scale reproduction of said grid indicia of said playing board;

a movable target, for placement upon said playing board;

a projectile firing cannon, for mounting upon said playing board, pivotable about both horizontal and vertical axes;

a direction and range finding means, constructed for pivotal attachment upon said plotting chart; and elevation finding means, for determining the proper orientation of the cannon about a horizontal axis, based upon the range of the movable target from the cannon.

2. The artillery game of claim 1, wherein said grid indicia of said playing board comprises:

a first array of spaced parallel grid indicia; and a second array of spaced parallel grid indicia, said second array being orthogonal to said first array.

3. The artillery game of claim 2, wherein said grid indicia of said first and second arrays are spaced so as to divide said playing board into a plurality of substantially square grid areas.

4. The artillery game of claim 3, wherein said movable taget is further characterized as being substantially square in shape and of such a size as to substantially cover one of said square grid areas.

5. The artillery game of claim 1, wherein said projectile firing cannon comprises:

a cannon barrel, having an internal cannon barrel bore;

a plunger, disposed in said cannon barrel bore and having a projectile receiving end;

resilient spring means, disposed between said plunger and said cannon barrel, for forcibly moving said projectile receiving end towards an open end of said cannon barrel; and means for releasing said plunger from a first cocked position so that it may be moved by said spring means to a second uncocked position, to eject a projectile from said cannon barrel.

6. The artillery game of claim 5, wherein said releasing means comprises:

an electromagnet, disposed in a lower end of said cannon for engagement with said plunger;

electrical circuit means for connecting said electromagnet to an electrical power source;

firing button means, disposed in said electrical circuit for breaking said circuit so that said electromagnet is deenergized, thereby releasing said plunger of said cannon.

7. An artillery game, comprising:

a playing board, having a range disposed thereon;

a plotting chart, including a scale reproduction of said range of said playing board;

a movable target, for placement upon said playing board;

a projectile firing cannon, having;

a substantially circular base for pivotal mounting upon said playing board;

a plurality of cannon direction indicia on said base; and first and second cannon mounting shoulders extending substantially vertically from said base for receiving a cannon barrel therebetween mounted for pivotal movement about a horizontal axis.

8. The artillery game of claim 7, wherein:

said first cannon mounting shoulder is constructed for receiving an electrical power source therein; and said cannon further comprises;

an electromagnetic plunger release means;

electrical circuit means, for connecting said electromagnetic release means to said power source; p2 an on-off switch, disposed in said circuit means and mounted upon said base; and a normally closed firing button, disposed in said circuit means and mounted upon said base, so that said cannon may be fired by depressing said firing button.

9. The artillery game of claim 7, wherein:

one of said cannon mounting shoulders has disposed thereon a protractor-like elevation indicator means.

10. The artillery game of claim 7, further comprising:

combination direction and range finder means, for pivotal attachment to said plotting chart; and means for determining a proper elevation of said cannon barrel corresponding to a given target range.

11. The artillery game of claim 10, wherein said combination direction and range finder means comprises:

a protractor type direction finder portion having a plurality of direction indicia thereon; and a straight edge type range finder, rigidly attached to said direction finder, and having a plurality of range indicia thereon.

12. The artillery game of claim 10, wherein said elevation determining means comprises:

range tabulation means; and elevation tabulation means, corresponding to said range tabulation means.

13. A method of directing a projectile from a cannon, mounted upon a playing board, towards a movable target located upon said playing board, comprising:

determining the location of said target upon said playing board by specifying first and second grid indicia area designation means;

plotting the location of said target upon a plotting chart having thereon a scaled reproduction of said playing board, including said grid area designation means;

determining from said plotting chart, the direction and range of said target from said cannon;

pivoting said cannon about a vertical axis so that it is oriented in the direction of said target, determined from said chart; and pivoting said cannon about a horizontal axis to an elevation such that the distance traveled by a projectile from said cannon substantially corresponds to the range of said target.

14. The method of claim 13, further comprising:

calibrating an elevation finder means.

15. The method of claim 13, wherein said target is constructed to substantially cover a square grid area defined upon said playing board and wherein said step of plotting comprises:

placing a map tack upon said plotting chart at the intersection of the diagonals of a square grid area corresponding to said square grid area of said playing board; and pivoting a combination direction-range finder, having a protractor type direction finder portion and a straight edge type range finder portion, until said straight edge engages said map tack.

* * * * *